US005236268A

United States Patent [19]

Chang

[11] Patent Number: 5,236,268

[45] Date of Patent: Aug. 17, 1993

[54] UNIVERSAL INPUT METHOD FOR CHINESE CHARACTERS

[76] Inventor: Daniel C. Chang, 652 187 St., Bronx, N.Y. 10458

[21] Appl. No.: 890,847

[22] Filed: Jun. 1, 1992

[51] Int. Cl.[5] ..... B41J 5/10

[52] U.S. Cl. ..... 400/484; 400/110

[58] Field of Search ..... 400/110, 109, 484, 487; 382/13, 56; 341/28

[56] References Cited

U.S. PATENT DOCUMENTS

| | | | |
|---|---|---|---|
| 4,559,615 | 12/1985 | Goo et al. | 400/110 |
| 4,602,878 | 7/1986 | Merner et al. | 400/110 |
| 4,669,901 | 6/1987 | Feng | 400/110 |
| 4,684,926 | 8/1987 | Yong-Min | 400/110 |
| 4,954,955 | 9/1990 | Chin | 400/110 |

*Primary Examiner*—Edgar S. Burr
*Assistant Examiner*—Ren Yan
*Attorney, Agent, or Firm*—Dowell & Dowell

[57] ABSTRACT

An input method including a novel keyboard facilitates entry of Chinese characters into a computer. Character Roots or Radicals are selected in accordance with the first pen-stroke used by Chinese in writing such Root or Radical and those that begin with the same stroke are symbolized on keys in separate selected sections of the keyboard. As a further aid, Roots or Radicals that have the same second pen-stroke are selected and symbolized on specified keys having a secondary identification design or motif. The method includes selecting, in the traditional Chinese order of writing, the first Root to be encoded and, from the keyboard, the key having such Root thereon, the location selection being facilitated as described above, and actuating the key, and continuing to select the second and third Roots in the character and actuating the corresponding keys.

6 Claims, 2 Drawing Sheets

| KEY | RADICALS (ROOTS) | VARIATIONS |
|---|---|---|
| [ ` ] | 王 (壬) 玉 ..... | 王 |
| [ 1 ] | 一 二 (ラ) 干 (丰) 青 (圭) 无 (无) 示 馬 ..... | 礻 |
| [ 2 ] | 言 音 門 龍 ..... | 言 音 龍 |
| [ 3 ] | 土 (垚 幸) ..... | 圭 |
| [ 4 ] | 木 ..... | 木 |
| [ 5 ] | 十 (丰 丰 丰) 寸 士 工 長 ..... | 丰 |
| [ 6 ] | 支 走 老 赤 車 (亶) | |
| [ 7 ] | 甘 (艹 甘 甘) 革 貢 奏 鼓 | |
| [ 8 ] | 臣 耳 豆 酉 | |
| [ 9 ] | 襾 (西) 革 彫 ..... | 西 襾 |
| [ 0 ] | 石 | |
| [ - ] | 厂 (广) 大 犬 而 面 豕 ..... | 犭 |
| [ = ] | 廾 尢 (无) 歹 辰 頁 | |
| [ \ ] | 匚 匚 弋 戈 比 牙 瓦 至 | |
| [ Q ] | 攴 止 虍 韭 齒 齒 ..... | 攵 |
| [ W ] | 丨 丿 業 (业 业 业) 小 (小 小 少 少) 卜 (卜) | |
| [ E ] | 口 | |
| [ R ] | 日 曰 (冒 曲) | |
| [ T ] | 目 (目) | |
| [ Y ] | 水 ..... | 氵 氷 |
| [ U ] | 虫 | |
| [ I ] | 肉 ..... | 月 |
| [ O ] | 足 ..... | 足 |
| [ P ] | 冂 (冂) 口 田 网 皿 ..... | 皿 罒 冗 罒 |
| [ [ ] | 山 巾 内 (内) 貝 見 骨 | |
| [ ] ] | 邑 里 黑 韋 黽 鼎 ..... | 阝 |
| [ESC] | 手 ..... | 手 扌 (扌) |
| [NUM] | 竹 (广) ..... | 灬 |
| [SCR] | 毛 气 矢 牛 (牛) 生 (壬) ..... | 牛 |
| [ 7 ] | 禾 (禾) 缶 舌 非 耒 香 黍 | |
| [ 8 ] | 白 自 (阝) 血 片 隹 身 | |
| [ 9 ] | 臼 (匚 臣 臼 臼 由) 阜 鬼 鼠 鼻 | |
| [ 4 ] | 人 ..... | 亻 |
| [ 5 ] | 辶 ..... | 辶 |
| [ 6 ] | 金 ..... | 钅 |
| [ 1 ] | 丿 入 彡 八 (丷 八) 行 | |
| [ 2 ] | 戶 斤 (斤) 爪 瓜 舟 食 禽 ..... | 户 ⺈ |
| [ 3 ] | 父 爻 (爻) 采 鬯 | |
| [ 0 ] | 儿 几 勹 (勿) 攵 攵 匕 鳥 (鳥) | |
| [DEL] | 夕 欠 殳 月 (彡) 用 舛 | |
| [ + ] | 氏 (氐) 色 角 風 魚 龜 | |
| [ A ] | 广 | |
| [ S ] | 衣 ..... | 衤 衣 |
| [ D ] | 亠 (去 亨) 广 文 方 | |
| [ F ] | 立 (产 产) 辛 玄 | |
| [ G ] | 高 齊 麻 鹿 | |
| [ H ] | 火 (灬) ..... | 灬 |
| [ J ] | 氵 (氵) 首 | |
| [ K ] | 米 羊 ..... | 羊 羊 |
| [ L ] | 丶 斗 宀 穴 | |
| [ ; ] | 一 | |
| [ ' ] | 心 ..... | 忄 小 |
| [ Z ] | 已 已 巳 尸 (尸 尸) 弓 ヨ (ヨ 彑) | |
| [ X ] | 聿 隶 艮 門 | |
| [ C ] | 艸 ..... | 艹 |
| [ V ] | 凵 屮 子 ..... | 子 |
| [ B ] | 阝 (阝 阝) 片 疋 (疋) ..... | 阝 |
| [ N ] | 女 辶 | |
| [ M ] | 刀 (刂 勹 色 角) 力 | |
| [ , ] | 又 皮 羽 飛 | |
| [ . ] | 厶 (マ) 矛 癶 (癶) | |
| [ / ] | 乙 巛 (川) 幺 毋 母 糸 ..... | 乚 く 巛 川 |

FIG. 1

UNIVERSAL INPUT METHOD FOR CHINESE CHARACTERS

FIELD OF INVENTION

This invention relates to the input of Chinese characters into a computer, and more particularly, for the universal usage of this method, whether the user understands Chinese or not. The principal requirement is for the user to recognize the graphics of about 200 Radicals, which are combined to form characters, but not necessarily the meaning of the Radical.

THE BACKGROUND

The input method for Chinese characters is actually an access method, since the graphics of the Chinese characters are already stored in the computer. The user accesses each desired character from the computer's memory. Access methods are either by phonetics or by figure. This invention accesses the characters by figure.

Chinese character input methods already known which access characters by figure have the following drawbacks:

1. They are difficult to learn especially for non-Chinese speaking people;

2. There too many characters under the same input code.

Government officials and business representatives from the computer industry from China, Taiwan, Hongkong, Japan, Korea and the United States have convened in China and Hong-Kong. They agreed to establish a standard Chinese character set of about 25,000 characters and to use the Radicals in the "Kang Xi Dictionary" as the standard Radicals. This invention employs this standard character set and uses the standard Radicals as the components for the Chinese characters.

BRIEF DESCRIPTION OF THE DRAWINGS

FIG. 1 is a table which lists the Radicals and Roots employed in the present invention with the associated key on the keyboard.

THE INVENTION

Figure 2:
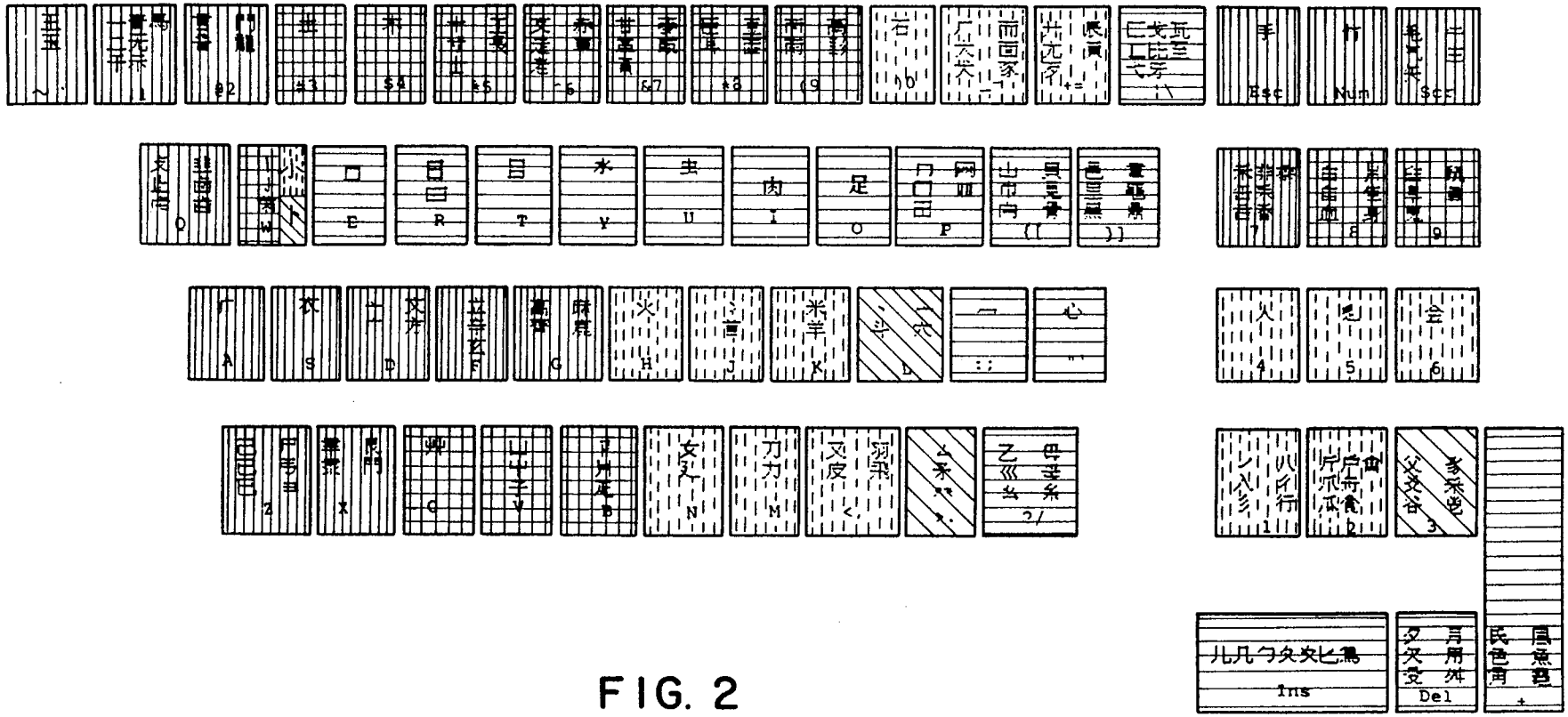
FIG. 2 is a representation of a conventional English language keyboard having Chinese Radicals applied thereto in accordance with the present invention.

This invention utilizes the breakdown of the Chinese character into Radical and Roots. The Radical which is the attribute or characteristic of the character has been used as the major classification standard for Chinese dictionaries for more than 1,800 years. The Root 15 a unit larger than a pen-stroke and which contains a certain number of pen-strokes in a definite configuration is the component to form a character. The Radical is a special type of Root Characters are formed of a number, usually three, Radicals or Roots. The Radicals and Roots used in this method are shown in FIG. 1 in which the components in parenthesis are the Roots derived from that Radical.

The present invention employs a breakdown of the character into Roots in accordance with the traditional Chinese writing sequence, based on the position of the Radical in a character. The priority and illustrations for determining the applicable or proper Radical in a character follows:

1. On top. For the character "嵬", "山" is on top, therefore, it is the proper Radical even though "鬼" is also a Radical.

2. On the left. For the character "鸛", even though the Radical should be "鳥", the meaning of "鳥" is bird, for the convenience of non-Chinese speaking people my method uses "青" as the Radical, since it is on the left of the character.

3. On the right. For the character "胡", even though "十" and "口" on the left are Radicals, they are two Radicals. The independent Radical "月" on the right, instead, is the proper Radical. The independent Radical has priority over the mixed Radicals.

4. On the bottom. For the character "恐", "心" is a Radical and is on the bottom. Since there is no independent Radical on the top or the left, "心", therefore, is the proper Radical.

5. On the upper left corner Sometims, there is no independent Radical. For the character "疑", the "匕" on the upper left corner is the proper Radical.

6. The first pen-stroke. For the character "九", there is no Radical other than the first pen-stroke "ノ", this first pen-stroke, therefore, is the proper Radical. In some other cases, the first pen-stroke such as "—", "丨", "丶" and "乙" (a symbol of non-linear pen-stroke) all may be assigned as the proper Radical.

The input procedure is as follows. The user breaks down the character into Radical and Roots from up to down or from left to right and responds to the queries on the screen. At the beginning, the query, "Which Radical ?", appears at the bottom of the screen. The user may press a Radical key if a Radical corresponds to a character. Then, the program prompts the queries "Root 1?", "Root 2?" and "Root 3?" which appear in sequence and the program waits for the user to press the specified Root keys (same as the Radical keys) accordingly.

Because the number of Radicals is more than the number of of keys on the keyboard, there are many keys with more than one Radical symbol on the same key. Sometimes, the computer wants to know which Radical or which Root you mean. Therfore, a query, "Which Radical ?" or "Which Root?" may appear on the screen. It asks the user to enter a number to designate the order of the Radical located on the key which is ordered from top to down and from left to right.

Finally, the inputted characters are displayed on the screen from the upper left corner one by one. It will start from the first position again when the screen is full. At the same time, the characters entered are also stored in a specified file. Conventional computer provisions for correcting errors and finishing the work are included in the keyboard.

A sample keyboard used for this method is set forth in FIG. 2. The sample keyboard is a 62 key portion of a standard keyboard having 88 keys and standard American indicia, but keyboards of other types may be arranged in a similar manner. The keyboard is divided into five areas, to distinguish the radicals by the type of first pen-stroke of the Radical, used by Chinese in traditional writing. In the center of the keyboard, the keys in the first row are used for the Radicals which start with a horizontal stroke (—); the keys in the second row are used for the Radicals which start with a vertical stroke (|); the keys in the third row are used for the Radicals which start with a dot stroke (·); the keys on the fourth row are used for the Radicals which start with a non-linear stroke (Z); the keys in the numeric keyboard are used for the Radicals which start with a slope stroke (/). Radical keys are further distinguished with different colors according to the type of the second pen-stroke of the Radical, used by Chinese in traditional writing. Thus, in the keyboard of FIG. 2, the keys colored red or otherwise designated as a group have Chinese symbols in which the second stroke is horizontal. Other group designations for the second stroke are as follows:

| | |
|---|---|
| Yellow | Vertical |
| Purple | Slope |
| Blue | Non-linear |
| Green | Dot |

From the operator's point of view, this is a method to write the Chinese characters by Radical and Roots instead of by pen-stroke.

Technically, this is a successive sub-classification system which breaks down the characters into four classification levels, the Radical and three Roots. This invention uses 62 Radical keys. Under each sub-classification, the program may produce 62 sub-groups. The total number of the sub-groups with four possible variations is the fourth power of 62 or 14,766,336 sub-groups. When applied to the proposed Chinese character set, on the average, 591 sub-groups contain only one character (14,766,336/25,000). Therefore, this invention produces a unique code for each character, with a few exceptions. If there are duplicate codes, all of the characters with the same code will be displayed and the user may key in the desired characters on a selected numerical key.

I claim:

1. A keyboard for encoding Chinese characters, each character formed of one or more radical roots, said keyboard arranged in sections of keys, each section covering a selected separate area of the keyboard, each section having indicia on its keys representing one or more radicals all of which begin with the same pen stroke, in which various of said sections have indicia for radicals whose first stroke is horizontal, vertical, a dot, non-linear, and a slope.

2. A keyboard as defined in claim 1, in which the keys having radicals of the same second pen stroke are similarly designated.

3. A keyboard as defined in claim 2, in which the keys are designated by different colors.

4. A method of keying in Chinese characters into a keyboard connected to a computer data bank of Chinese characters, each character formed of one or more radical roots, the keyboard having indicia on the keys representing one or more radical roots, comprising, providing selected sections of the keyboard indicia arranged on the keyboard so that only radical roots that begin with the same stroke are on keys in the same section, selecting, for a Chinese character, the first radical root to be encoded, in the traditional order of writing, selecting the keyboard section having the same beginning stroke as said first radical root and actuating the key within such section having such root.

5. The method of claim 4, and, selecting for such character, the second radical root to be encoded, in the traditional order of writing, and actuating the key within such section having such root.

6. The method of claim 5, and, selecting for such character, the third radical root to be encoded, in the traditional order of writing, and actuating the key within such section having such root.

* * * * *